United States Patent [19]

Williams

[11] Patent Number: 4,556,602

[45] Date of Patent: Dec. 3, 1985

[54] REINFORCED PRIMARY BACKING FOR CARPET

[75] Inventor: Franklin E. Williams, Buena Vista, Va.

[73] Assignee: Burlington Industries, Inc., Greensboro, N.C.

[21] Appl. No.: 613,745

[22] Filed: May 23, 1984

Related U.S. Application Data

[63] Continuation of Ser. No. 446,416, Dec. 2, 1982, abandoned.

[51] Int. Cl.[4] ..... B32B 5/16

[52] U.S. Cl. ..... 428/259; 428/95

[58] Field of Search ..... 428/95, 259

[56] References Cited

U.S. PATENT DOCUMENTS 4,145,467 3/1979 Malik ..... 428/95

*Primary Examiner*—Marion E. McCamish

*Attorney, Agent, or Firm*—Cushman, Darby & Cushman

[57] ABSTRACT

A reinforced polypropylene primary backing for carpets and carpet tiles in which the polypropylene warp yarns have another synthetic yarn woven into the warp in order to increase the strength in the warp direction. The reinforcing yarn is a synthetic yarn which is non-stretchable or at least less stretchable than polypropylene when exposed to the temperatures developed during a hot melt resin process step during the manufacturing of tufted carpet.

4 Claims, 2 Drawing Figures

REINFORCED PRIMARY BACKING FOR CARPET

This is a continuation of application Ser. No. 446,416, filed Dec. 2, 1982 now abandoned.

BACKGROUND OF THE INVENTION

1. Field of the Invention

The present invention relates to a new and novel reinforced primary backing made primarily of woven polypropylene where the backing is reinforced in the warp direction by weaving yarns other than polypropylene into the backing at predetermined intervals across the width. The other yarn in order to impart the requisite improved dimensional stability to the backing will either be non-stretchable or less stretchable than polypropylene.

2. Description of the Prior Art

In recent years, tufted pile fabrics utilizing primary and secondary backings made from synthetic plastic materials have been developed for use indoors and outdoors. These carpets have utilized synthetic plastic primary and secondary backings in order to provide stability to the carpet structure and to eliminate the problems encountered previously by carpets which have been made from natural fibers. Carpets made from natural fibers are subject to shrinking and rotting in abnormal weather conditions and when liquids are spilled thereon. Additionally, such carpets are subject to excessive staining and require frequent removal and cleaning.

In U.S. Pat. No. 3,110,905 issued Nov. 19, 1963 to Rhodes and U.S. Pat. No. 3,336,178 issued Aug. 15, 1976 to Levitch, and both assigned to the same assignee as the instant application, namely, Burlington Industries, Inc., there are disclosed tufted pile fabrics utilizing synthetic plastic backings and pile yarn also made from synthetic plastic or man-made fibers. While the tufted pile fabric disclosed in these two patents have been commercially successful for installations wherein the floor covering is subjected to rotting conditions, moisture conditions from rain or spillage of liquids, they have not been completely satisfactory when used in situations wherein the carpeting is to be substantially permanently installed by adhesively securing the same to a floor structure, particularly when the primary and secondary backings are bonded together with a hot melt adhesive. With the advent of the use of hot melt adhesives and the application of such technology to the disclosures in these two patents and particularly to the disclosure in Levitch, the resulting tufted pile fabric provided greatly improved adhesion between the synthetic primary and secondary backings, effectively preventing separation of the primary and the carpet face from the secondary, when the secondary is bonded to a floor structure. Additionally, the hot melt adhesive greatly improves pile bind, effectively preventing removal of carpet tufts from the carpet face by pulling or snagging.

U.S. Pat. No. 3,110,905 to Rhodes discloses the basic woven synthetic primary carpet backing. In essence, such a primary backing is formed of a flat weave of synthetic yarns in which every point on the primary backing is of substantially uniform thickness. While, Rhodes teaches the use of any synthetic yarn capable of being spun, extruded, or shaped into a flattened or rectangular shape, polypropylene and polyethylene are disclosed as most suitable. Other suitable synthetic yarns which are listed in the Rhodes patent are acrylic, modacrylic, polyester, nylon, rayon, acetate, triacetate, cellulosic, vinyl, vinylidene, chloride and polyvinyl chloride. However, in actuality, the most commonly used woven synthetic primary backings are made entirely of polypropylene yarns employed for both the warp and weft.

As discussed hereinabove, polypropylene primary backings are used in various hot melt processes. During the course of applying hot melt resins to carpets having polypropylene primary backings the heat from the hot resin renders the polypropylene primary backing susceptible to stretchings in the machine direction, i.e., length direction, during subsequent process steps thereby losing a portion of its dimensional stability.

The stretching imparts instability to the carpet product particulary when the carpet is cut and sold as carpet tiles. This instability, in turn, leads to excess shrinkage, cupping and domeing of the carpet or carpet tiles.

While there have been various attempts to improve the dimensional stability of backings, e.g., U.S. Pat. Nos. 4,296,159, 4,242,394, 4,123,577 and 4,131,704, none of these appear to have efficiently and economically solved the stretching of polypropylene backings caused by a hot melt resin application.

Therefore, it is the object of the present invention to overcome the stretching problem and the resultant decrease in dimensional stability discussed hereinabove.

SUMMARY OF THE INVENTION

Even though the Rhodes and Levitch patent, U.S. Pat. Nos. 3,110,903 and 3,336,178, respectively, were assigned to the instant assignee, Burlington Industries, Inc., it has heretofore been impossible to prevent the stretching problem caused by the application of hot melt resin to woven polypropylene carpet primary backings. Now, however, it has been discovered that by adding to the polypropylene warp yarns certain other synthetic yarns, the primary backing's susceptibility to stretching is significantly reduced. In fact, the dimensional stability of a primary backing of the present invention is such that problems associated with and caused by such stretching are virtually eliminated.

The reinforced primary backing of the present invention comprises a woven polypropylene backing wherein synthetic yarns which are non-stretchable or less stretchable than the polypropylene yarns, at the temperatures reached by the hot melt resin application, are woven into the backing as warp yarns together with the polypropylene warp yarns. The synthetic yarns which are preferred for purposes of reinforcement are nylon, polyester and fiberglass. In addition, the reinforcement yarns should have the following physical characteristics:

(1) Continuous filament, non crimped;

(2) about 500 denier or greater, or in the case of fiberglass the denier equivalent;

(3) high tenacity of about 7.5 grams per denier or greater; and (4) low elongation with the elongation at the break point being no more than about 25%.

The increase in strength of the reinforced primary backing will depend on the type of reinforcing yarn employed and the amount of such yarn woven into the backing, but the strength should be increased by at least about 20% to be effective. The improvement in the strength of the final carpet product will vary considerably depending upon the laminate used with the backing.

However, with a thermoplastic laminate system the dimensional stability of the final carpet product should be improved by at least about 40%.

DETAILED DESCRIPTION OF THE DRAWINGS AND THE INVENTION

Figure 1:
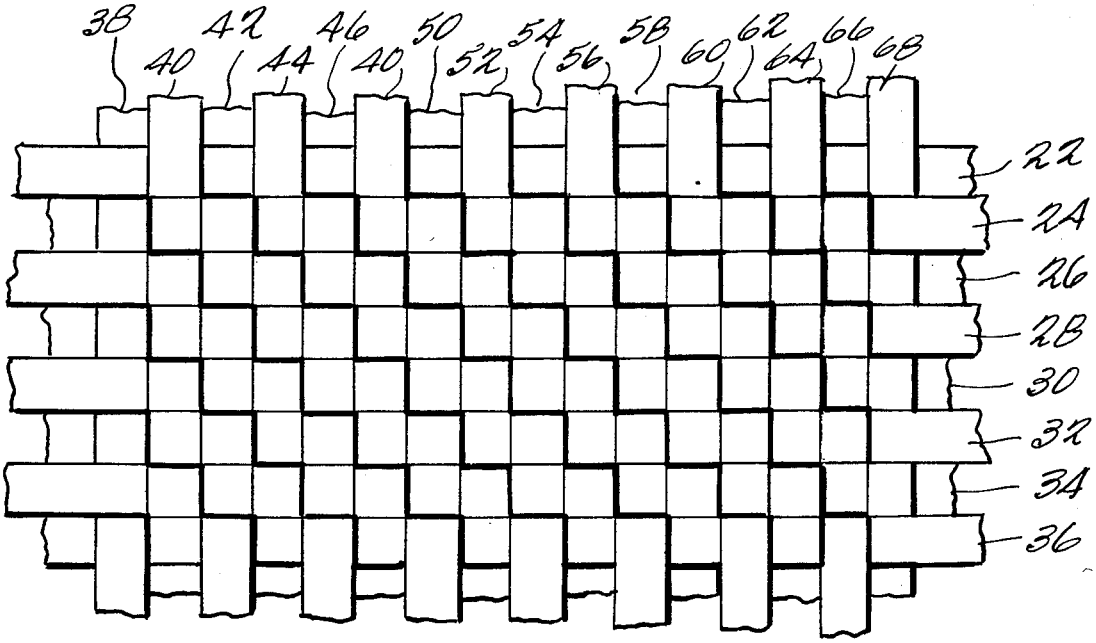
FIG. 1 is a bottom view of a woven primary backing made from polypropylene warp and weft yarns.

Referring to the drawings, FIG. 1 is a bottom view of a woven primary polypropylene backing where the warp and weft yarns are interwoven at one to one weave.

The primary backing 20 comprises a series of polypropylene warp yarns 22–36 which are interwoven in a one to one weave with a series of polypropylene weft yarns 38–68. The relatively even thickness and width of the polypropylene warp and weft yarns results in a substantially uniform woven backing material having a thickness equivalent to yarn strands at every point in the fabric. It is, however, understood that the present invention is applicable with any synthetic woven backing material and that the thickness and width of the warp and weft yarns of the backing have no effect on the present invention. Therefore, the present invention can be employed using warp and weft yarns having any range of dimensions and weaving ratios.

Moreover, the present invention is suitable for use with any synthetic yarns.

Figure 2:
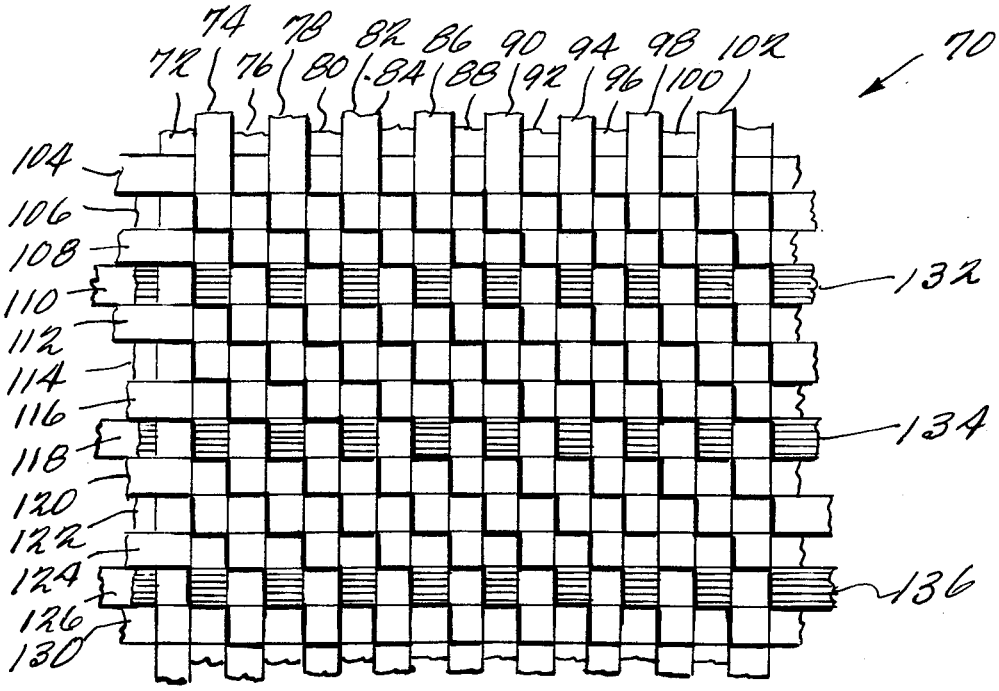
FIG. 2 is a bottom view of the reinforced backing of the present invention wherein a portion of the warp yarns are a synthetic yarn either nonstretchable or less stretchable than polypropylene.

FIG. 2 illustrates a reinforced backing of the present invention wherein synthetic yarns less susceptible to stretching deformation than polypropylene yarn in a subsequent hot melt resin application are added as reinforcement to the polypropylene warp yarns.

The reinforced primary backing 70 has polypropylene weft yarns 72–102 and polypropylene warp yarns 104–130 woven at a one to one weave. Woven as warp yarns at predetermined intervals are a series of synthetic yarn less stretchable than polypropylene when subject to the heat imparted to the yarns from a hot melt resin application. These warp yarns 132, 134 and 136 can be any synthetic yarn which is non-stretchable or less stetchable than the polypropylene yarns under the conditions discussed hereinabove and are preferably nylon, polyester and fiber glass.

In another embodiment, the reinforcing yarns simply replace a predetermined number of the polypropylene warp yarns and are made an integral part of the one-to-one weave (not shown).

Moreover, the reinforcing yarn in order to function effectively should have the following physical properties. The yarn is preferably a noncrimped continuous filament having a denier preferable to at least about 500, and in the case of fiber glass, the denier equivalent. The yarn is of high tenacity with a preferred tenacity of at least about 7.5 grams per denier. Finally, it should have a low elongation with preferably an elongation at break point of no more than about 25%.

The reinforced primary backing of the present inventor, in order to function effectively, should have an increased strength in the warp direction of at least about 20% greater than that of a normal primary backing consisting of only polypropylene warp and weft yarns. The strength in the warp direction is a function of several factors including, inter alia, the synthetic yarn selected as the reinforcing material, the physical properties and dimensions of the reinforcing yarn as woven into the backing, and the spacing of the reinforcing yarns as they are woven into the backing. These various factors are dependent upon the specific requirements of the particular carpet or carpet tile being manufactured. Once these factors are analyzed the appropriate reinforcing yarn can be selected and woven into the polypropylene backing at predetermined intervals.

What is claimed is:

1. A reinforced primary backing for tufted carpets, said backing having non-fibrillated polypropylene warp and weft yarns wherein polyester yarns are woven into the warp as a reinforcing yarn by substituting said polyester yarn for preselected warp yarn at predetermined spaced intervals, said polyester yarn being a noncrimped continuous filament without fibrillation having (a) a denier of at least about 500, (b) a tenacity of at least about 7.5 grams per denier, and (c) an elongation at break point of less than about 25%.

2. A reinforced primary backing for tufted carpets, said backing having non-fibrillated polypropylene warp and weft yarns wherein polyester yarns are woven into the warp as a reinforcing yarn by overlaying the warp yarn at predetermined spaced intervals with said polyester yarn, said polyester yarn being a noncrimped continuous filament without fibrillation having (a) a denier of at least about 500, (b) a tenacity of at least about 7.5 grams per denier, and (c) an elongation at break point of less than about 25%.

3. A reinforced primary backing for tufted carpets, said backing having non-fibrillated polypropylene warp and weft yarns wherein polyester yarns are woven into the warp as a reinforcing yarn by substituting said polyester yarn for preselected warp yarns at predetermined space intervals, said polyester yarn being a noncrimped continuous filament without fibrillation having (a) a denier of at least about 500, (b) a tenacity of at least about 7.5 grams per device, and (c) an elongation at breakpoint of less than about 25%, said reinforced backing having the strength on the warp direction increased over a nonreinforced polypropylene backing by at least about 20%.

4. A reinforced primary backing for tufted carpets, said backing having non-fibrillated polypropylene warp and weft yarns wherein polyester yarns are woven into the warp as a reinforcing yarn by overlaying the warp yarns at predetermined spaced intervals with said polyester yarn, said polyester yarn being a noncrimped continuous filament without fibrillation having (a) a denier of at least about 500, (b) a tenacity of at least about 7.5 grams per device, and (c) an elongation at breakpoint of less than about 25%, said reinforced backing having the strength on the warp direction increased over a nonreinforced polypropylene backing by at least about 20%.

* * * * *

UNITED STATES PATENT AND TRADEMARK OFFICE

CERTIFICATE OF CORRECTION

PATENT NO. : 4,556,602

DATED : Dec. 3, 1985

INVENTOR(S) : Franklin E. Williams

It is certified that error appears in the above-identified patent and that said Letters Patent is hereby corrected as shown below:

The title page should be deleted to appear as per attached title page.

The sheet of Drawing consisting of Figure 1 should be deleted to appear as per attached sheet.

Signed and Sealed this

Seventh Day of October, 1986

[SEAL]

*Attest:*

DONALD J. QUIGG

*Attesting Officer*

*Commissioner of Patents and Trademarks*

United States Patent [19]

Williams

[11] Patent Number: 4,556,602

[45] Date of Patent: Dec. 3, 1985

[54] REINFORCED PRIMARY BACKING FOR CARPET

[75] Inventor: Franklin E. Williams, Buena Vista, Va.

[73] Assignee: Burlington Industries, Inc., Greensboro, N.C.

[21] Appl. No.: 613,745

[22] Filed: May 23, 1984

Related U.S. Application Data

[63] Continuation of Ser. No. 446,416, Dec. 2, 1982, abandoned.

[51] Int. Cl.[4] ..... B32B 5/16

[52] U.S. Cl. ..... 428/259; 428/95

[58] Field of Search ..... 428/95, 259

[56] References Cited

U.S. PATENT DOCUMENTS 4,145,467 3/1979 Malik ..... 428/95

*Primary Examiner*—Marion E. McCamish

*Attorney, Agent, or Firm*—Cushman, Darby & Cushman

[57] ABSTRACT

A reinforced polypropylene primary backing for carpets and carpet tiles in which the polypropylene warp yarns have another synthetic yarn woven into the warp in order to increase the strength in the warp direction. The reinforcing yarn is a synthetic yarn which is non-stretchable or at least less stretchable than polypropylene when exposed to the temperatures developed during a hot melt resin process step during the manufacturing of tufted carpet.

4 Claims, 2 Drawing Figures

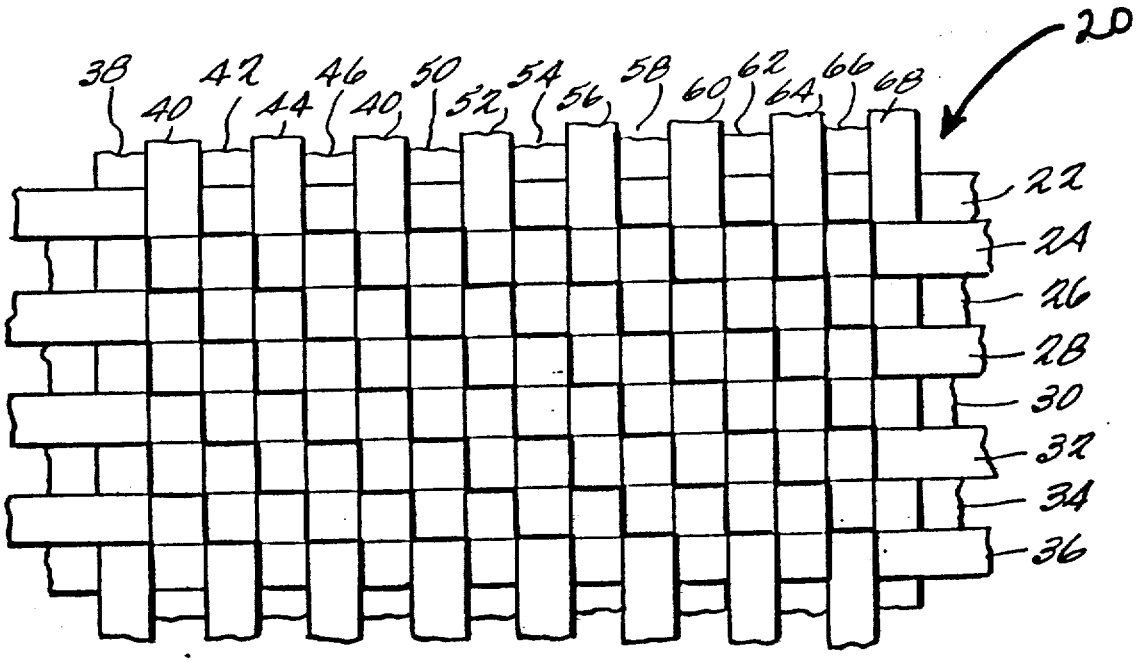

UNITED STATES PATENT AND TRADEMARK OFFICE

CERTIFICATE OF CORRECTION

PATENT NO. : 4,556,602

DATED : December 3, 1985

INVENTOR(S) : Franklin E. WILLIAMS

It is certified that error appears in the above-identified patent and that said Letters Patent is hereby corrected as shown below:

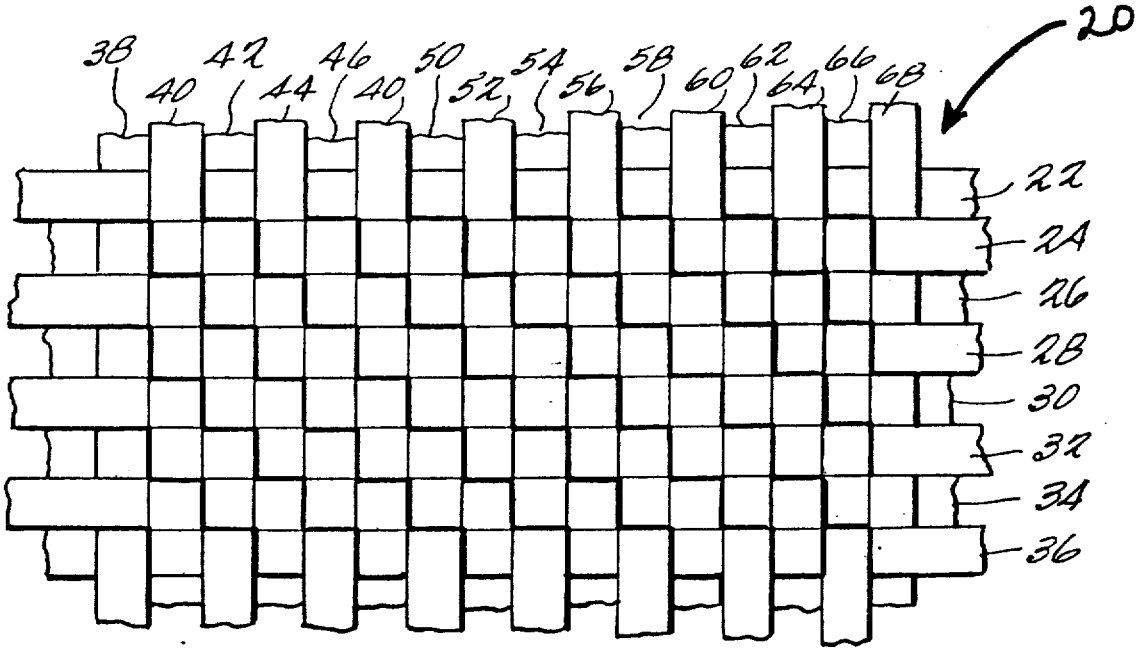

FIG. 1